US011135698B2

(12) United States Patent
Satake et al.

(10) Patent No.: US 11,135,698 B2
(45) Date of Patent: Oct. 5, 2021

(54) PROCESSING APPARATUS, PROCESSING METHOD, AND STORAGE MEDIUM

(71) Applicant: Tokyo Electron Limited, Tokyo (JP)

(72) Inventors: Keigo Satake, Kumamoto (JP); Kenji Nakamizo, Kumamoto (JP); Yuichi Douki, Kumamoto (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 301 days.

(21) Appl. No.: 15/181,527

(22) Filed: Jun. 14, 2016

(65) Prior Publication Data

US 2016/0368114 A1 Dec. 22, 2016

(30) Foreign Application Priority Data

Jun. 16, 2015 (JP) ..... JP2015-120840

(51) Int. Cl.
*B24B 37/005* (2012.01)
*B24B 37/20* (2012.01)

(52) U.S. Cl.
CPC ..... *B24B 37/005* (2013.01); *B24B 37/20* (2013.01)

(58) Field of Classification Search
CPC ..... B24B 57/00; B24B 57/02; B24B 57/04; B24B 37/005; B24B 37/20
See application file for complete search history.

(56) References Cited

U.S. PATENT DOCUMENTS 6,125,876 A * 10/2000 Laederich ..... B24B 37/04 137/255
6,722,943 B2 * 4/2004 Joslyn ..... B24B 37/04 451/287

(Continued)

FOREIGN PATENT DOCUMENTS

JP 09-270373 A 10/1997
JP 2003-234280 A 8/2003

(Continued)

OTHER PUBLICATIONS

Wescott, Tim. "PID without a PhD." Oct. 1, 2000. <https://www.embedded.com/design/prototyping-and-development/4211211/PID-without-a-PhD>.*

*Primary Examiner* — Orlando E Aviles
*Assistant Examiner* — Joel D Crandall
(74) *Attorney, Agent, or Firm* — Abelman, Frayne & Scwhab

(57) ABSTRACT

Disclosed is a processing apparatus that includes a chamber accommodating a workpiece, a nozzle provided within the chamber, a measuring unit measuring the supply flow rate of the processing fluid supplied to the nozzle, an opening/closing unit performing opening/closing of the flow path of the processing fluid, and a controller. The controller sends an opening/closing operation signal that causes the opening/closing unit to perform an opening/closing operation according to recipe information that indicates processing contents. After sending the opening/closing operation signal to the opening/closing unit according to the recipe information, the controller starts the integration of the supply flow rate based on the measurement result of the measuring unit, monitors the rise of the supply flow rate based on the calculated integrated amount, and when supplying a specific flow rate, (Continued)

monitors the supply flow rate based on a value actually measured by the measuring unit.

13 Claims, 8 Drawing Sheets

(56) References Cited

U.S. PATENT DOCUMENTS

| | | | | |
|---|---|---|---|---|
| 6,814,835 | B2 * | 11/2004 | Kim | B24B 57/02 137/47 |
| 9,770,804 | B2 * | 9/2017 | Byers | B24B 57/02 |
| 2004/0072503 | A1 * | 4/2004 | Chang | B24B 37/04 451/41 |
| 2007/0289529 | A1 * | 12/2007 | Shimai | H01L 21/6715 118/688 |
| 2012/0276816 | A1 * | 11/2012 | Ono | B24B 37/015 451/7 |

FOREIGN PATENT DOCUMENTS

| | | | | |
|---|---|---|---|---|
| JP | 2014-086577 | A | 5/2014 | |
| JP | 2014086577 | A * | 5/2014 | G05B 15/02 |
| JP | 2015-095583 | A | 5/2015 | |
| WO | 2006/001343 | A | 1/2006 | |
| WO | WO-2006001343 | A1 * | 1/2006 | G05D 7/0688 |

* cited by examiner

PROCESSING APPARATUS, PROCESSING METHOD, AND STORAGE MEDIUM

CROSS-REFERENCE TO RELATED APPLICATIONS

This application is based on and claims priority from Japanese Patent Application No. 2015-120840 filed on Jun. 16, 2015 with the Japan Patent Office, the disclosure of which is incorporated herein in its entirety by reference.

TECHNICAL FIELD

An exemplary embodiment disclosed herein relates to a processing apparatus, a processing method, and a storage medium.

BACKGROUND

Conventionally, a substrate processing apparatus has been known which performs a processing on a substrate such as, for example, a semiconductor wafer or a glass substrate by supplying a processing liquid to the substrate from a nozzle provided within a chamber.

However, the processing liquid needs to be supplied at a specific flow rate which is required for the processing of the substrate. Accordingly, a substrate processing apparatus has been known which is provided with a flowmeter in a processing liquid supply path of a processing liquid and performs a processing liquid supply control based on a measurement result of the flowmeter so as to enable the processing liquid to be stably supplied at a specific flow rate as described above based on a measurement result of the flowmeter (see, e.g., Japanese Patent Laid-Open Publication No. 2003-234280).

SUMMARY

A processing apparatus according to exemplary embodiment includes a chamber, a nozzle, a measuring unit, an opening/closing unit, and a controller. The chamber accommodates an object to be processed ("workpiece"). The nozzle is provided within the chamber to supply a processing liquid toward the workpiece. The measuring unit measures the supply flow rate of the processing fluid supplied to the nozzle. The opening/closing unit performs opening/closing of the flow path of the processing fluid supplied to the nozzle. The controller sends an opening/closing operation to the opening/closing operation signal that causes the opening/closing unit to perform an opening/closing operation according to recipe information that indicates processing contents.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
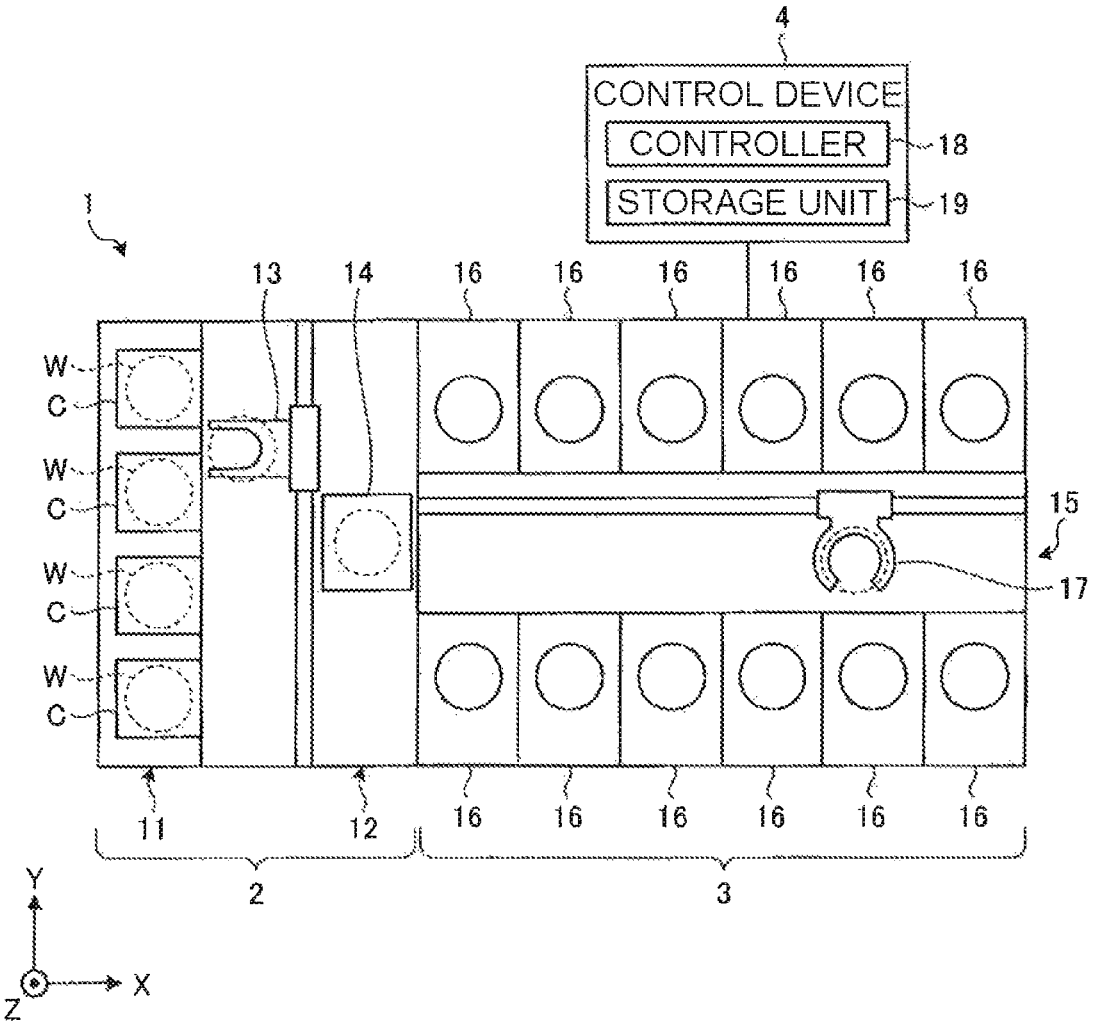
FIG. 1 is a view illustrating a schematic configuration of a substrate processing system according to an exemplary embodiment of the present disclosure.

In the following detailed description, reference is made to the accompanying drawing, which form a part hereof. The illustrative embodiments described in the detailed description, drawing, and claims are not meant to be limiting. Other embodiments may be utilized, and other changes may be made without departing from the spirit or scope of the subject matter presented here.

The technique disclosed in Japanese Patent Laid-Open Publication No. 2003-234280 monitors a supply flow rate of a processing liquid at the time when the processing liquid is supplied at a specific flow rate, and does not monitor a supply flow rate of the processing liquid when the supply flow rate rises toward a specific flow rate (e.g., when the supply of the processing liquid to a substrate is started). Thus, even if a variation occurred among substrates with respect to the supply flow rate of the processing liquid at the time of the rise of the supply flow rate, the variation could not have been recognized.

Such a problem is not limited to a liquid processing fluid, and commonly occurs in general processing fluids including a gaseous processing fluid. Further, the problem is not limited to a substrate processing apparatus, and also commonly occurs in general processing apparatuses which perform a processing on a workpiece by supplying a processing fluid to the workpiece.

An aspect of an exemplary embodiment is to provide a processing apparatus, a processing method, and a processing method, and a storage medium which are capable of monitoring a supply flow rate of a processing unit when the processing fluid is supplied at a specific flow rate, and monitoring the supply flow rate when the supply flow rate rises toward the specific flow rate.

A processing apparatus according to an aspect of an exemplary embodiment includes a chamber, a nozzle, a measuring unit, an opening/closing unit, and a controller. The chamber accommodates an object to be processed ("workpiece"). The nozzle is provided within the chamber to supply a processing liquid toward the workpiece. The measuring unit measures the supply flow rate of the processing fluid supplied to the nozzle. The opening/closing unit performs opening and closing of the flow path of the processing unit supplied to the nozzle. The controller sends an opening/closing operation signal that causes the opening/closing unit to perform an opening/closing operation according to recipe information that indicates processing contents. In addition, after sending the opening/closing operation signal to the opening/closing unit according to the recipe information, the controller starts the integration of the supply flow rate based on the measurement result of the measuring unit, monitors the rise of the supply flow rate based on the calculated integrated amount, and at the time of supplying a specific flow rate, monitors the supply flow rate based on a value actually measured by the measuring unit.

In the above-described processing apparatus, the controller measures an actual elapsed time until the integrated amount reaches a preset target integrated amount, and monitors a deviation between the actual elapsed time and the target integrated amount.

In the above-described processing apparatus, the controller monitors a deviation between the integrated amount at a preset target elapsed time and the target integrated amount corresponding to the target elapsed time.

In the above-described processing apparatus, the target integrated amount is preset based on a required amount of the processing fluid that is required until the processing fluid reaches a surface of the workpiece from start of the supply of the processing fluid.

The above-described processing apparatus further includes an arm configured to support the nozzle horizontally, a pivoting and lifting mechanism configured to pivot and lift the arm, and a supply pipe that penetrates the arm, and the pivoting and lifting mechanism, and the required amount is preset based on the volume of the supply pipe.

In the above-described processing apparatus, in a case where a predetermined elapsed time, which is shorter than the target elapsed time, has elapsed from the start of the supply of the processing fluid, the controller samples an instantaneous value of the supply flow rate plural times at a predetermined period, and monitors whether an average value of the sampled instantaneous values is in a predetermined range.

In the above-described processing apparatus, in a case where the deviation prior to an actual operation of the processing apparatus is in a range that requires a correction, the controller causes, during the actual operation, the start of the supply of the processing liquid from the nozzle is executed at a shifted timing according to the deviation.

In the above-described processing apparatus, the controller monitors the rise of the supply flow rate during an actual operation of the processing fluid whenever the processing fluid is supplied to the nozzle.

According to an aspect of an exemplary embodiment, there is provided a processing method using a processing apparatus, which includes a processing container configured to accommodate an object to be processed ("workpiece"), a nozzle provided within the chamber to supply a processing fluid toward the workpiece, a measuring unit configured to measure a supply flow rate of the processing fluid supplied to the nozzle, and an opening/closing unit configured to perform opening/closing of a flow path of the processing fluid supplied to the nozzle. The processing method includes: a control step of sending an opening/closing operation signal to cause the opening/closing unit to perform an opening/closing operation according to recipe information that indicates processing contents. After sending the opening/closing operation signal to the opening/closing unit according to the recipe information, the control step includes: starting integration of the supply flow rate is started based on a measurement result of the measuring unit, monitoring a rise of the supply flow rate with the calculated integrated amount, and when supplying a specific flow rate, monitoring the supply flow rate with a value actually measured by the measuring unit.

According to an aspect of an exemplary embodiment, there is provided a non-transitory computer-readable storage medium which is operated on a computer and stores a computer executable program. When executed, the program causes a computer to control a processing apparatus such that the processing method claimed in claim 9 is performed.

According to the exemplary embodiments, the supply flow rate of a processing liquid at the time of supplying a specific flow rate may be monitored, and the supply flow rate of the processing liquid at the time of the rise toward the specific flow rate may be monitored.

Hereinafter, exemplary embodiments of a processing apparatus, a processing method, and a storage medium disclosed herein will be described in detail. The present disclosure is not limited by the exemplary embodiments described below. In addition, descriptions will be made with reference to a case in which the processing apparatus is a substrate processing system, as an example.

FIG. 1 is a view illustrating an outline of a substrate processing system provided with a processing unit according to an exemplary embodiment of the present disclosure. In the following, in order to clarify positional relationships, the X-axis, Y-axis and Z-axis which are orthogonal to each other will be defined. The positive Z-axis direction will be regarded as a vertically upward direction.

As illustrated in FIG. 1, a substrate processing system 1 includes a carry-in/out station 2 and a processing station 3. The carry-in/out station 2 and a processing station 3 are provided adjacent to each other.

The carry-in/out station 2 is provided with a carrier placing section 11 and a transfer section 12. In the carrier placing section 11, a plurality of carriers C is placed to accommodate a plurality of substrates (semiconductor wafers in the present exemplary embodiment) (hereinafter, referred to as "wafers W") horizontally.

The transfer section 12 is provided adjacent to the carrier placing section 11, and provided with a substrate transfer device 13 and a delivery unit 14. The substrate transfer device 13 is provided with a wafer holding mechanism configured to hold the wafer W. Further, the substrate transfer device 13 is movable horizontally and vertically and pivotable around a vertical axis, and transfers the wafers W between the carriers C and the delivery unit 14 by using the wafer holding mechanism.

The processing station 3 is provided adjacent to the transfer section 12. The processing station 3 is provided with a transfer section 15 and a plurality of processing units 16. The plurality of processing units 16 is arranged at both sides of the transfer section 15.

The transfer section 15 is provided with a substrate transfer device 17 therein. The substrate transfer device 17 is provided with a wafer holding mechanism configured to hold the wafer W. Further, the substrate transfer device 17 is movable horizontally and vertically and pivotable around a vertical axis. The substrate transfer device 17 transfers the wafers W between the delivery unit 14 and the processing units 16 by using the wafer holding mechanism.

The processing units 16 perform a predetermined substrate processing on the wafers W transferred by the substrate transfer device 17.

Further, the substrate processing system 1 is provided with a control device 4. The control device 4 is, for example, a computer, and includes a controller 18 and a storage unit 19. The storage unit 19 stores a program that controls various processings performed in the substrate processing system 1. The controller 18 controls the operations of the substrate processing system 1 by reading and executing the program stored in the storage unit 19.

Further, the program may be recorded in a computer-readable storage medium, and installed from the storage medium to the storage unit 19 of the control device 4. The computer-readable storage medium may be, for example, a hard disc (HD), a flexible disc (FD), a compact disc (CD), a magnet optical disc (MO), or a memory card.

In the substrate processing system 1 configured as described above, the substrate transfer device 13 of the carry-in/out station 2 first takes out a wafer W from a carrier C placed in the carrier placing section 11, and then places the taken wafer W on the transfer unit 14. The wafer W placed on the transfer unit 14 is taken out from the transfer unit 14 by the substrate transfer device 17 of the processing station 3 and carried into a processing unit 16.

The wafer W carried into the processing unit 16 is processed by the processing unit 16, and then, carried out from the processing unit 16 and placed on the delivery unit 14 by the substrate transfer device 17. After processed and placed on the delivery unit 14, the wafer W returns to the carrier C of the carrier placing section 11 by the substrate transfer device.

Figure 2:
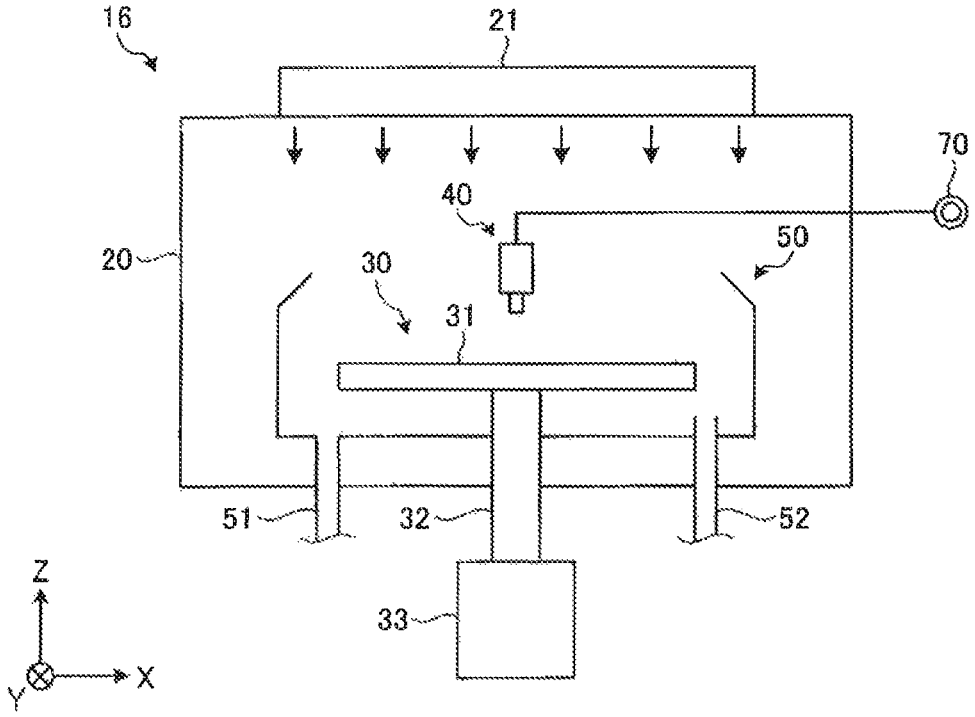
FIG. 2 is a view illustrating a schematic configuration of a processing unit.

Next, an outline of the processing unit 16 will be described with reference to FIG. 2. FIG. 2 is a view illustrating an outline of the processing liquid 16.

As illustrated in FIG. 2, the processing unit 16 is provided with a chamber 20, a substrate holding mechanism 30, a processing fluid supply unit 40, and a recovery cup 50.

The chamber 20 accommodates the substrate holding mechanism 30, the processing fluid supply unit 40, and the recovery cup 50. A fan filter unit (FFU) 21 is provided on the ceiling of the chamber 20. The FFU 21 forms a downflow in the chamber 20.

The substrate holding mechanism 30 is provided with a holding unit 31, a support unit 32, and a driving unit 33. The holding unit 31 holds the wafer W horizontally. The support unit 32 is a vertically extending member, and has a base end portion supported rotatably by the driving unit 33 and a tip end portion supporting the holding unit 31 horizontally. The driving unit 33 rotates the support unit 32 around the vertical axis. The substrate holding mechanism 30 rotates the support unit 32 by using the driving unit 33, so that the holding unit 31 supported by the support unit 32 is rotated, and hence, the wafer W held in the holding unit 31 is rotated.

The processing fluid supply unit 40 supplies a processing fluid onto the wafer W. The processing fluid supply unit 40 is connected to a processing fluid source 70.

The recovery cup 50 is disposed to surround the holding unit 31, and collects the processing liquid scattered from the wafer W by the rotation of the holding unit 31. A drain port 51 is formed on the bottom of the recovery cup 50, and the processing liquid collected by the recovery cup 50 is discharged from the drain port 51 to the outside of the processing unit 16. Further, an exhaust port 52 is formed on the bottom of the recovery cup 50 to discharge a gas supplied from the FFU 21 to the outside of the processing unit 16.

Figure 3A:
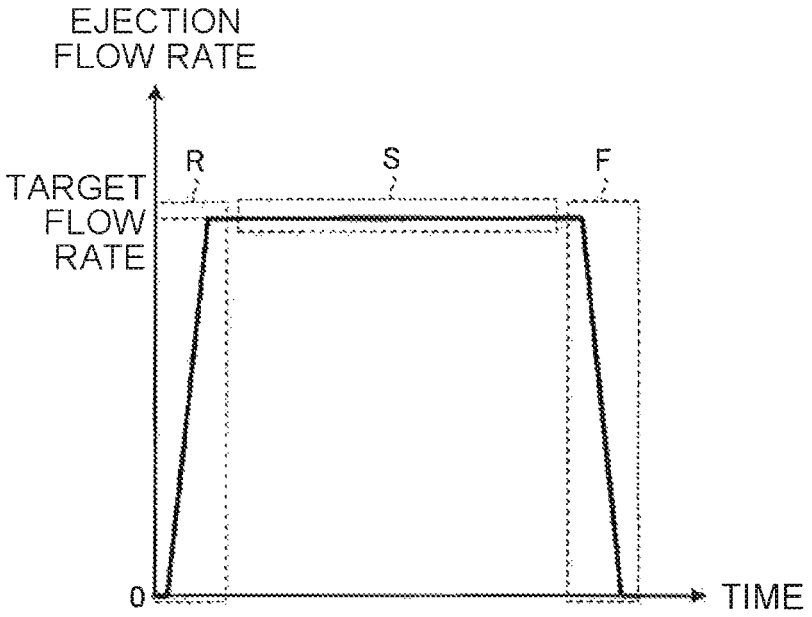
FIG. 3A is a (first) schematic explanatory view of a flow rate monitoring method according to an exemplary embodiment.
Figure 3B:
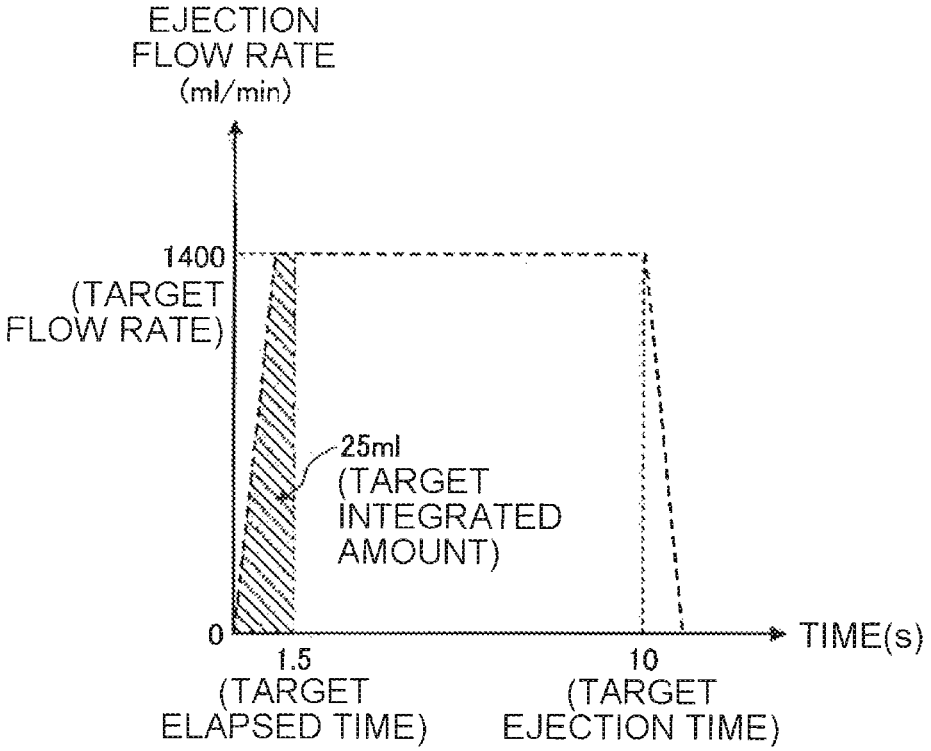
FIG. 3B is a (second) schematic explanatory view of a flow rate monitoring method according to an exemplary embodiment.
Figure 3C:
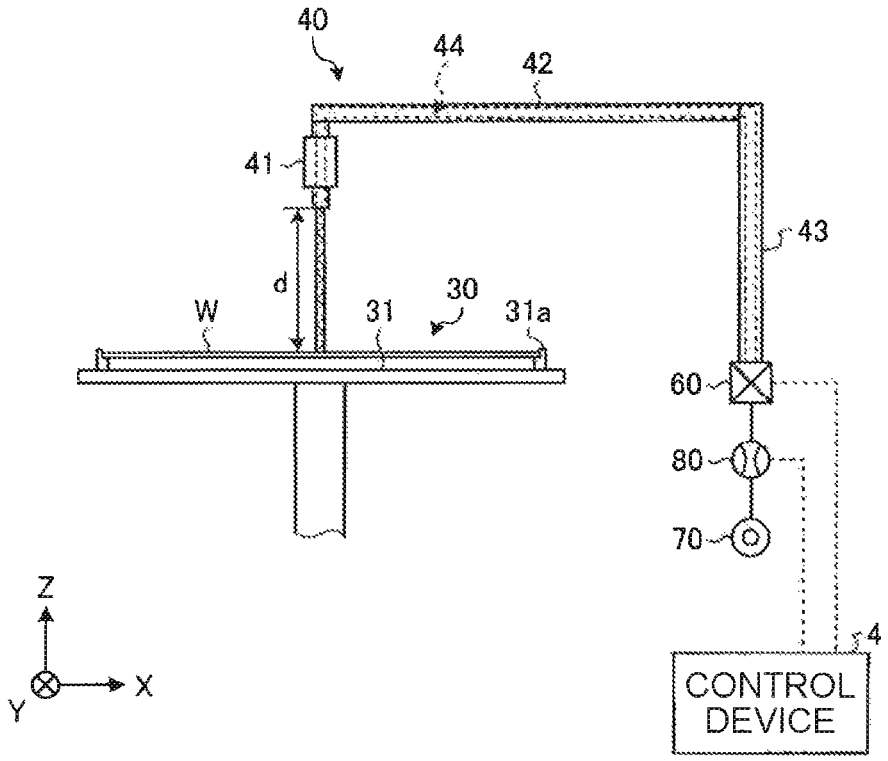
FIG. 3C is a (third) schematic explanatory view of a flow rate monitoring method according to an exemplary embodiment.

Next, an outline of a method of monitoring a flow rate of a processing fluid according to the present exemplary embodiment will be described by using FIGS. 3A to 3C. FIGS. 3A to 3C are (first to third) schematic explanatory views of a flow rate monitoring method according to an exemplary embodiment.

In addition, hereinafter, the explanation will be made with reference to a case where the processing fluid supplied by the processing fluid supply unit 40 is a processing liquid, as a primary example. Accordingly, a supply flow rate of the processing liquid supplied by the processing fluid supply unit 40 will be referred to as an "ejection flow rate."

In addition, in each of the drawings to be referred to hereinafter, a change of the ejection flow rate may be represented by a waveform, and this waveform is represented mainly in a trapezoidal waveform. However, this is merely for convenience of explanation, and is not intended to limit the actual change of the ejection flow rate.

As illustrated in FIG. 3A, the flow rate monitoring method according to the present exemplary embodiment is adapted to monitor the ejection flow rate of the processing liquid even during a time period in which the ejection flow rate exhibits a so-called transient change such as, for example, a rise and a fall, without being limited to a time period of a stable supply (see the portion surrounded by the dashed line rectangle S).

Here, the rise or the fall refers to a time transition of the ejection flow rate when the ejection flow rate is changed from a first flow rate to a second flow rate. For example, the "rise" (see the portion surrounded by the dashed line rectangle R) refers to a time transition of the ejection flow rate when the ejection flow rate is changed from "zero (0)" to a predetermined "target flow rate." The "target flow rate" corresponds to a preset "specific flow rate" which is required for a processing of the wafers W and is set in recipe information 19*a*. In addition, the "fall" (see the portion surrounded by the dashed line rectangle F) refers to a time transition of the ejection flow rate when the ejection flow rate is changed from the "target flow rate" to "zero (0)."

By monitoring the rise or the fall, it is possible to detect an inter-device difference (so-called variation) of processing fluid supply units 40 which is caused from, for example, a machine manufacturing error or a deterioration by aging. Further, based on the result, it is possible to determine presence/non-presence of abnormality in the processing fluid supply units 40.

The flow rate monitoring method according to the present exemplary embodiment will be described in more detail with reference to FIGS. 3B and 3C. In addition, hereinafter, the explanation will be made with reference to a case where the "rise" is mainly monitored, as an example.

As illustrated in FIG. 3B, in the flow rate monitoring method according to the present exemplary embodiment, a target elapsed time and a target integrated amount corresponding to the target elapsed time are preset first. The target elapsed time and the target integrated amount are reference values of an elapsed time and an integrated amount from the start of the ejection of the processing liquid, respectively, and become indexes for determining presence/non-presence of abnormality or detecting an inter-device difference as described above.

Specifically, the target integrated amount is set based on an amount of the processing liquid which is required until the processing liquid reaches a surface of the wafer W from the start of the ejection of the processing liquid. For example, the target integrated flow rate is set as follows. As illustrated in FIG. 3C, a processing fluid supply unit 40 includes a nozzle 41, an arm 42 that supports the nozzle 41 horizontally, and a pivoting and lifting mechanism 43 that pivots and lifts the arm 42.

A supply pipe 44 penetrates through the inside of each of the nozzle 41, the arm 42, and the pivoting and lifting mechanism 43. The processing liquid is supplied to the supply pipe 44 from the processing fluid supply source 70 through a valve 60. The valve 60 corresponds to an example of the opening/closing unit, and performs opening/closing of a flow path of the processing liquid to be supplied to the nozzle 41 according to "an opening/closing operation signal" sent from the controller 18. The processing liquid, which is supplied to the supply pipe 44 when the valve 60 is opened, passes through the pivoting and lifting mechanism 43, the arm 42, and the nozzle 41 in this order, and is ejected toward the wafer W held horizontally in a state of being slightly spaced apart from the top surface of the holding unit 31 by a holding member 31*a* of the holding unit 31.

In addition, the target integrated amount is set based on, for example, the volume of the above-described supply pipe 44. In addition, a distance d from the tip end of the nozzle 41 to the surface of the wafer W and a diameter of the supply pipe 44 (a thickness of the processing liquid to be ejected) may be additionally taken into account. In this way, it is possible to derive the amount of the processing liquid which is required for the time period until the processing liquid reaches the surface of the wafer W from the start of the ejection of the processing liquid.

Here, it is assumed that an ejection start timing of the processing liquid indicates, for example, a timing when an ejection start signal sent from the controller 18 is received by the valve 60. Meanwhile, it is assumed that an ejection end timing of the processing liquid indicates a timing when an ejection end signal sent from the controller 18 is received by the valve 60. The ejection start signal and the ejection end signal correspond to examples of the "opening/closing operation signal."

In the flow rate monitoring method according to the present exemplary embodiment, the presence/non-presence of abnormality in the above-described rise is determined by monitoring a deviation of the actual ejection flow rate or the actual elapsed time actually required by the nozzle 41 with respect to the preset target integrated amount or the target elapsed time. Details of the monitoring of the deviation will be described later using FIGS. 6A and 6B.

In addition, an actual ejection flow rate of the nozzle 41 is measured by the measuring unit 80. As illustrated in FIG. 3C, the measuring unit 80 is, for example, a flowmeter, and is provided, for example, between the processing fluid supply source 70 and the valve 60.

Returning to FIG. 3B, the flow rate monitoring method according to the present exemplary embodiment also monitors an instantaneous value of the ejection flow rate when a predetermined elapsed time, which is shorter than the target elapsed time, elapses from the start of the supply of the processing liquid. The predetermined elapsed time, which is shorter than the target elapsed time, refers to, for example, an elapsed time which slightly before the target elapsed time represented in FIG. 3B.

In the flow rate monitoring method according to the present exemplary embodiment, the instantaneous value of the ejection flow rate from the start of the ejection of the processing liquid is monitored so as to monitor whether the ejection flow rate normally increases toward the target flow rate at the time of the stable supply, in other words, whether the rise of the ejection flow rate deviates from an allowable range. Details of the instantaneous value monitoring will be described later using FIG. 6C.

Figure 6A:
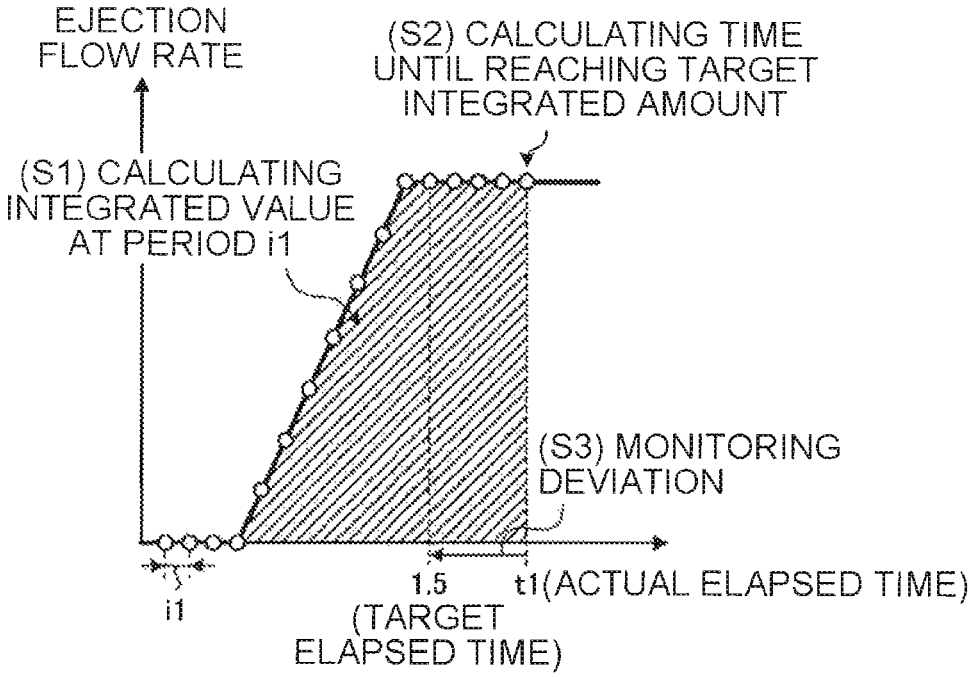
FIG. 6A is a (first) explanatory view in a case where a controller functions as a monitoring unit and a determination unit.
Figure 6B:
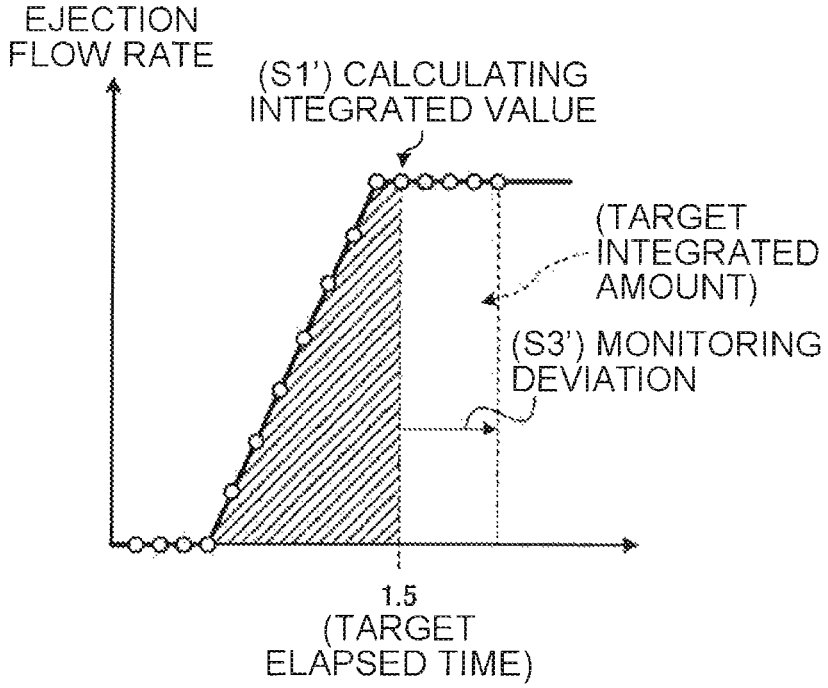
FIG. 6B is a (second) explanatory view in a case where a controller functions as a monitoring unit and a determination unit.

In addition, for the convenience of the subsequent descriptions, FIG. 6B represents examples of the target elapsed time, the target integrated amount, and so on. As illustrated in FIG. 3B, in the present exemplary embodiment, it is assumed that the target elapsed time is "1.5 sec," the target integrated amount is "25 ml," the target flow rate is "1,400 ml," and a target ejection time is "10 sec." The target ejection time refers to a time from the "start of ejection" to the "end of ejection." The numerical values represented in FIG. 3B are merely examples, and are not intended to limit actually set numerical values.

Figure 4:
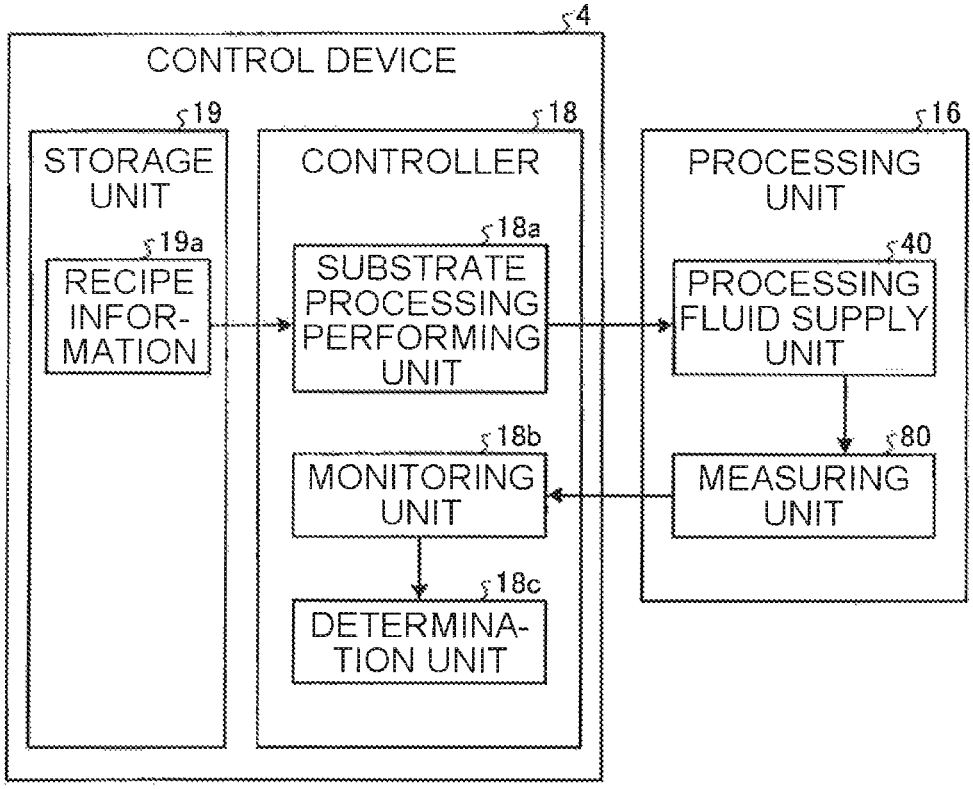
FIG. 4 is a block diagram of a control device.

Next, the control device 4 will be more specifically described with reference to FIG. 4. FIG. 4 is a block diagram of the control device 4. In FIG. 4, the components necessary to describe the features of the present exemplary embodiment are represented in functional blocks, and descriptions of general components are omitted.

In other words, each of the components illustrated in FIG. 4 is functionally conceptual, and is not necessarily required to be configured physically as illustrated therein. For example, the concrete forms of distribution or integration of the individual functional blocks are not limited to those illustrated, and all or some of the functional blocks may be configured to be functionally or physically distributed or integrated in arbitrary units depending on, for example, various loads or use conditions.

In addition, all or some of the processing functions performed in the individual functional blocks of the control device 4 are implemented by a processor such as, for example, a central processing unit (CPU) and a program analyzed and executed by the processor, or by hardware using a wired logic.

First, as described above, the control device 4 includes the controller 18 and the storage unit 19 (see FIG. 1). The controller 18 is, for example, a CPU, and reads and executes a program (not illustrated) stored in the storage unit 19 so as to function as, for example, each of the functional blocks 18*a* to 18*c* illustrated in FIG. 4. Subsequently, the individual functional blocks 18*a* to 18*c* will be described.

As illustrated in FIG. 4, the controller 18 includes, for example, a substrate processing performing unit 18*a*, a monitoring unit 18*b*, and an output timing changing unit 18*c*. The storage unit 19 stores recipe information 19*a* therein.

When the controller 18 functions as the substrate processing performing unit 18*a*, the controller 18 controls the processing unit 16 according to the recipe information 19*a* stored in the storage unit 19 to perform a series of substrate processings including a chemical liquid processing that supplies a chemical liquid to the wafer W, a rinse processing that supplies a rinse liquid to the wafer W, and a dry processing that dries the wafer W.

In this case, according to the recipe information 19*a*, the controller 18 sends, to the valve 60 of the processing fluid supply unit 40, an opening/closing operation signal so as to cause the processing fluid supply unit 40 to eject a predetermined processing liquid according to the substrate processing contents. The ejection flow rate by the processing fluid supply unit 40 is measured by the measuring unit 80, and the measurement result is notified to the monitoring unit 18*b* for each measurement.

The recipe information 19*a* is information that indicates the substrate processing contents. Specifically, the recipe information 19*a* is information in which the respective processing contents to be executed with respect to the processing unit 16 during the substrate processings are registered in advance in the order of processing sequence.

Here, the respective processing processings also include, for example, the types of processing liquids to be ejected by the processing fluid supply unit 40 depending on the substrate processing contents.

Figure 5:
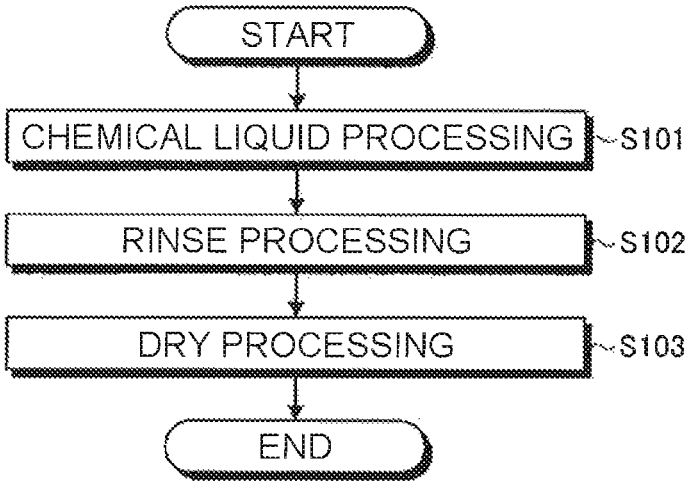
FIG. 5 is a flow chart illustrating a processing sequence of a series of substrate processings performed in a processing unit.

Here, the processing sequence of the series of substrate processings which are controlled by the controller 18 and performed in the processing unit 16 will be described with reference to FIG. 5. FIG. 5 is a flow chart illustrating a sequence of a series of substrate processings performed in the processing unit 16.

As illustrated in FIG. 5, in the processing unit 16, the chemical liquid processing (step S101), the rinse processing (step S102), and the dry processing (step S103) are performed in this order.

In the chemical liquid processing, dilute hydrofluoric acid (DHF) is ejected from the nozzle 41 toward the wafer W. In the rinse processing, deionized water (DIW) is ejected from the nozzle 41 toward the wafer W so that the DHF on the wafer W is washed away. In the dry processing, isopropyl alcohol (IPA), which is a kind of an organic solvent, is ejected from the nozzle 41 to the wafer W so that the DIW on the wafer W is removed so that the wafer W is dried.

In addition, each of the processing liquids, i.e., DHF or DIW is stored in a separate processing fluid supply source 70, and ejected from the nozzle 41 by opening/closing of a separate valve 60. Although not illustrated in FIG. 5, a processing of replacing the wafer W within the chamber 20 is performed after the dry processing is ended.

Returning to FIG. 4, a case where the controller 18 functions as the monitoring unit 18*b* will be described. When functioning as the monitoring unit 18*b*, the controller 18 monitors at least the rise of the ejection flow rate based on the measurement result of the measuring unit 80.

Specifically, after sending the opening/closing operation signal to the valve 60 of the processing fluid supply unit 40 according to the recipe information 19*a*, the controller 18 starts integration of the supply flow rate based on the measurement result of the measuring unit 80, and monitors the rise of the supply flow rate based on the calculated integrated amount. In addition, the controller 18 monitors the supply flow rate based on a value actually measured by the measuring unit 80, at the time of supplying a specific flow rate. In addition, when functioning as the determination unit 18*c*, the controller 18 determines presence/non-presence of abnormality in the processing fluid supply unit 40 based on the monitoring result by the monitoring unit 80.

Figure 6C:
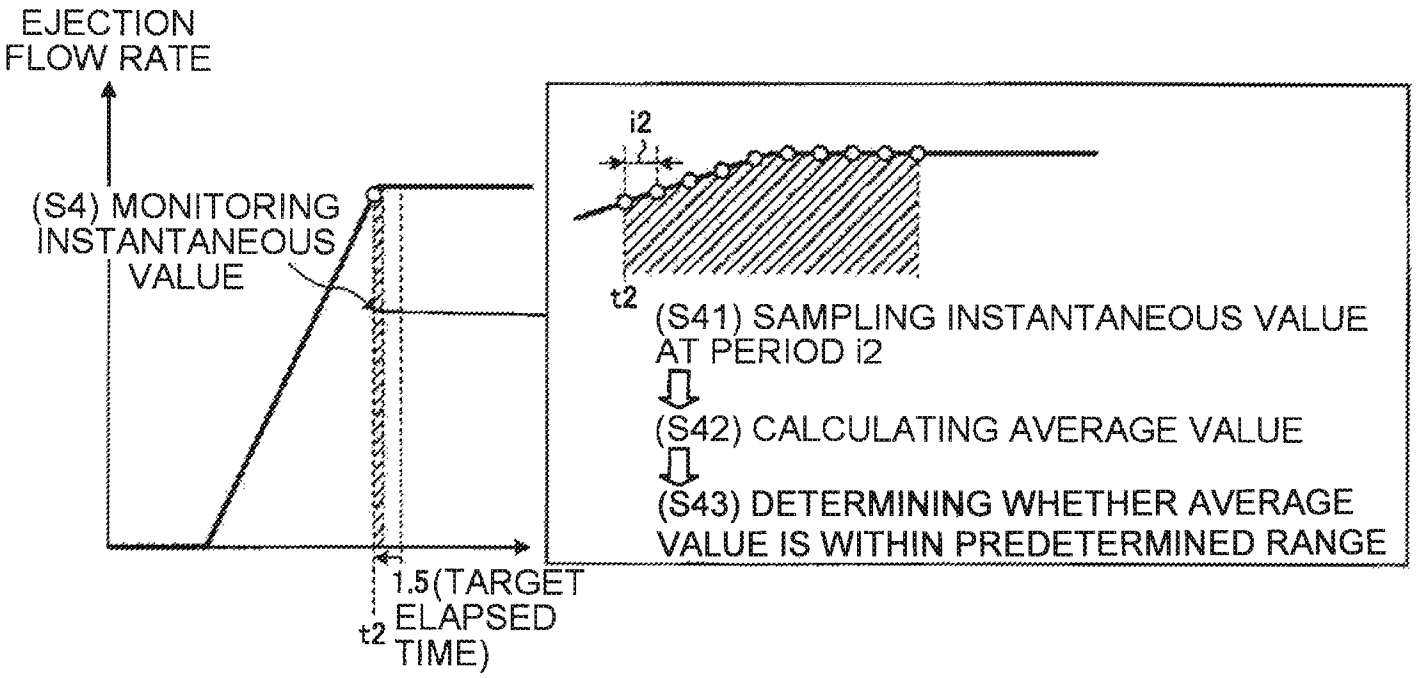
FIG. 6C is a (third) explanatory view in a case where a controller functions as a monitoring unit and a determining unit.

The case where the controller 18 functions as the monitoring unit 18*b* and the determination unit 18*c* will be described in more detail with reference to FIGS. 6A and 6B. FIGS. 6A to 6C are (first to third) explanatory views of the case where the controller 18 functions as the monitoring unit 18*b* and the determination unit 18*c*. In FIGS. 6A and 6B, the "integrated value" corresponds to the integrated amount calculated by the controller 18.

As illustrated in FIG. 6A, when the controller 18 functions as the monitoring unit 18*b*, the controller 18 calculates, for example, an integrated value of the ejection flow rate of the processing liquid at a predetermined period i1 from the start of the ejection (step S1). The period i1 may be, for example, about 10 msec to about 100 msec.

Then, the controller 18 measures a time required until the integrated value of step S1 reaches the predetermined target integrated amount (step S2). In addition, here, the time until the integrated value reaches the target integrated amount is referred to as an actual elapsed time t1.

Then, the controller 18 monitors a deviation between the measured actual elapsed time t1 and the target elapsed time (step S3), and determines presence/non-presence of abnormality in the processing fluid supply unit 40 based on the monitoring result.

For example, when the deviation of the time required to reach the above-described target integrated amount is within a predetermined range in which the deviation is correctable according to the opening/closing timing of the valve, the controller 18 corrects the opening/closing timing of the valve 60. In addition, when the deviation is not within the correctable range, the controller 18 may executes a predetermined processing at the time of determining abnormality (e.g., outputting an alarm to an output device such as, for example, a display unit or stopping the substrate processing).

In addition, as another example of the monitoring of the deviation, the controller 18 may calculate an integrated value of the ejection flow rate of the processing fluid in a predetermined target elapsed time (step S1'), and monitor a deviation between the integrated value and the predetermined target integrated amount (step S3'). Even with such a case, a presence or presence/non-presence of abnormality in the processing fluid supply unit 40 may be determined depending on a degree of the deviation.

In addition, without being limited to the monitoring of the deviation based on the integrated value of the ejection flow rate as illustrated in FIGS. 6A and 6B, the controller 18 also monitors an instantaneous value of the ejection flow rate in the case where a predetermined elapsed time, which is shorter than the target elapsed time, is elapsed from the start of the supply of the processing liquid as illustrated in FIG. 6C (step S4). Here, a predetermined elapsed time is assumed as a time t2, and during the period from the time t2 to the target elapsed time, the controller 18 performs both of the monitoring of the rise of the ejection flow rate and the monitoring of ejection flow rate with reference to the target flow rate.

Specifically, as illustrated in FIG. 6C, the controller performs samples the instantaneous values of the ejection flow rate plural times at a predetermined period from the time t2 (step S41). The period i2 may be, for example, about 10 msec to about 50 msec.

Then, the controller 18 calculates an average value of the instantaneous values sampled plural times (step S42), and determines whether the calculated average value is within a predetermined range, for example, based on the target flow rate (step S43). By acquiring the average value of the instantaneous values, a steep variation of the ejection flow rate may be smoothed so that it is possible to make an insensitive and gradual abnormality determination.

For example, it is assumed that the predetermined elapsed time is 1 sec, and the predetermined range based on the target flow rate (1,400 ml) is ±1% of the target flow rate. In this case, when the average value of the instantaneous values sampled after 1 sec from the start of the ejection is within a range of 1,386 ml to 1,414 ml, the controller 18 determines it as normal which means that no abnormality exists in the processing fluid supply unit 40, and causes a series of substrate processings to be continued.

In addition, when the average value of the sampled instantaneous values is not within the range, the controller 18 executes a predetermined processing in determining the abnormality as described above.

Next, the processing sequence of the monitoring and determination processings preformed when the controller 18 functions as a monitoring unit 18*b* and a determination unit 18*c* will be described with reference to FIG. 7.

Figure 7:
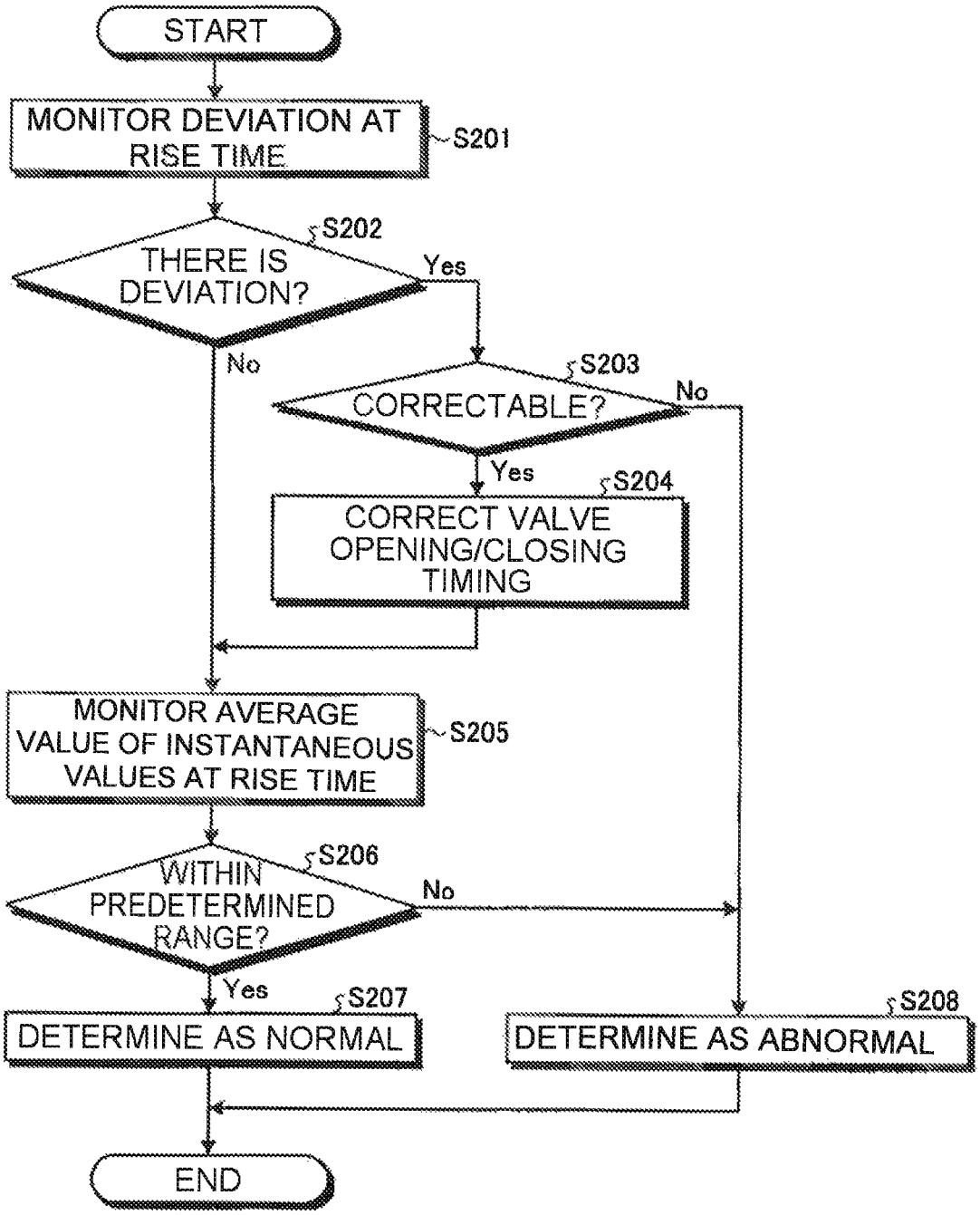
FIG. 7 is a flowchart illustrating a processing sequence in the case where the controller functions as a monitoring unit and a determination unit.

FIG. 7 is a flowchart illustrating a processing sequence of the monitoring and determination processings preformed when the controller 18 functions as a monitoring unit 18*b* and a determination unit 18*c*. FIG. 7 mainly illustrates the processing sequence in the case where an ejection flow rate is monitored when the ejection flow rate rises toward a specific flow rate, and omits illustration for the case where the ejection flow rate at the time of a specific flow rate supply. First, the controller 18 monitors a deviation at the time of the rise of the ejection flow rate (step S201). The deviation refers to the deviation based on the integrated value of the above-described ejection flow rate.

In addition, the controller 18 determines whether there is a deviation (step S202). Here, when there is a deviation (step S202, Yes), the controller 18 determines whether it is a correctable deviation (step S203).

Here, in the where the deviation is correctable (step S203, Yes), the controller 18 corrects the opening/closing timing of the valve 60 (step S204), and shifts the control to step S205. In addition, when the deviation is not correctable (step S203, No), the controller 18 determines that an abnormality exists in the processing fluid supply unit 40 (step S208), and terminates the processing.

When there is no deviation (step S202, No), the controller 18 monitors an average value of the instantaneous values at the time of the rise of the ejection flow rate (S205). In addition, the controller 18 determines whether the average value is within a predetermined range that uses the target flow rate as a reference.

Here, when the average value of the instantaneous values is in the predetermined range (step S206, Yes), the controller 18 determines that no abnormality exists in the processing fluid supply unit 40 (step S207), and terminates the processing.

In addition, when the average value of the instantaneous values is not in the predetermined range (step S206. No), the controller 18 determines that an abnormality exists in the processing fluid supply unit 40 (step S208), and terminates the processing.

In addition, the processing sequence represented in FIG. 7 may be repeatedly performed whenever the ejection of the processing liquid from the processing fluid supply unit 40 is performed during the performance of the series of substrate processings of the substrate processing system 1 in the actual operation thereof.

Accordingly, for example, in the flowcharts illustrated in FIG. 5, whenever each of the chemical liquid processing of step S101, the rinse processing of step S102, and the dry processing of step S103 is executed, the processing sequence of FIG. 7 may be executed according to each of the steps S101 to S103.

By this, for example, it is possible to perform the correction of a deviation or determination of an abnormality to correspond to a dynamic change in the deviation in the actual operation.

In addition, the processing sequence of FIG. 7 may also be executed in an evaluation step or an initial setting step prior to the actual operation of the substrate processing system 1, without being limited to the execution during the actual operation. By this, in the case where it has been determined that the deviation is, for example, in the predetermined range that requires correction in the evaluation step or the initial setting step, it is possible, during the actual operation, for the controller 18 to perform, for example, the initial setting in advance such that the processing fluid supply unit 40 executes the start of the execution of the processing liquid at a shifted timing according to the deviation.

As described above, the substrate processing system 1 (corresponding to an example of the "processing apparatus") according to the present exemplary embodiment includes the chamber 20, at least one nozzle 41, the measuring unit 80, the valve 60 (corresponding to an example of the "opening/closing unit"), and the controller 18.

The chamber 20 accommodates a wafer W (corresponding to an example of a "workpiece"). The nozzle 41 is provided within the chamber 20 to supply a processing liquid (corresponding to an example of the "processing fluid"). The measuring unit 80 measures an ejection flow rate (corresponding to an example of the "supply flow rate") of the processing liquid supplied to the nozzle 41. The valve 60 performs opening/closing of a flow path of the processing liquid to be supplied to the nozzle 41. The controller 18 sends an opening/closing operation signal to cause the valve 60 to perform an opening/closing operation according to the recipe information indicating the contents of a substrate processing (corresponding to an example of the "processing").

In addition, after sending the opening/closing operation signal to the valve 60 according to the recipe information 19*a*, the controller 18 starts integration of the supply flow rate based on the measurement result of the measuring unit 80, and monitors the rise of the supply flow rate based on the calculated integrated amount. At the time of supplying a specific flow rate, the controller 18 monitors the supply flow rate based on a value actually measured by the measuring unit 80.

Thus, according to the substrate processing system 1 of the present exemplary embodiment, the supply flow rate of the processing liquid at the time of supplying a specific flow rate may be monitored, and the supply flow rate of the processing liquid at the time of the rise toward the specific flow rate may be monitored. By this, the supply flow rate of the processing liquid at the time of the rise toward the specific flow rate and the supply flow rate of the processing liquid at the time of supplying the specific flow rate may be monitored without any break.

In addition, in the above-described exemplary embodiments, DHF is exemplified as an example of the chemical liquid. Besides, however, for example, SC1, SC2, SPM, a resist, a resolution solution, a silylation agent, and ozone water may be used as the chemical liquid.

In addition, the rinse liquid also is not limited to the above-described DIW. For example, when the contents of the rinse processing include a processing of supplying DIW to a wafer W and a processing of substituting DIW on the wafer W with isopropyl alcohol (IPA), the rinse liquid also includes the IPA.

The above-described exemplary embodiments have been described mainly with reference to the rise of the ejection flow rate as an example. However, the fall of the ejection flow rate may be monitored likewise. When the fall is monitored, it is possible to control, for example, the opening/closing of the valve 60 such that the processing liquid is ejected to the wafer W always in a constant amount and for a constant time, for example, by detecting a deviation from the above-described target integrated amount.

In addition, the above-described exemplary embodiments have been described mainly with reference to the liquid processing fluid as an example. However, when, for example, N2 gas which is a kind of inert gas is used in, for example, the dry processing, and the gas is supplied from a nozzle 41, the above-described exemplary embodiments may be applied to the rise or the fall of a supply flow rate of the gas.

The above-described exemplary embodiments have been described with reference to a case where the workpiece is a wafer W, as an example. However, the above-described exemplary embodiments may be generally applied to a processing apparatus which performs a processing on a workpiece by supplying a processing fluid to the workpiece.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A processing apparatus comprising;

a chamber configured to accommodate an object to be processed ("workpiece");

a nozzle provided within the chamber to supply a processing fluid toward the workpiece;

a flowmeter configured to measure a flow rate of the processing fluid supplied to the nozzle;

a valve configured to perform an opening/closing of a flow path of the processing fluid supplied from a processing fluid supply through a supply pipe and out the nozzle to a surface of the workpiece; and a controller configured to control a processing operation of the processing apparatus according to a processing recipe, wherein the controller is configured to:

transmit a control signal to the valve such that the valve is opened to start supplying the processing fluid to the workpiece;

calculate an integrated amount of the processing fluid supplied to the workpiece during a first period in which the flow rate rises by integrating the measured flow rate over an elapsed time until the integrated amount reaches a target integrated amount during the first period; and after the first period, measure an instantaneous flow rate of the processing fluid supplied to the workpiece during a second period in which the flow rate is maintained in a substantially same level, wherein the target integrated amount is a required amount of the processing fluid in the flow path that is required for the processing fluid to reach the surface of the workpiece from the processing fluid supply source, and preset based on a volume of the supply pipe, a diameter of the supply pipe, and a distance from a tip end of the nozzle to the surface of the workpiece.

2. The processing apparatus of claim 1, wherein the controller is further configured to calculate the integrated amount until the elapsed time reaches a predetermined time set in advance during the first period, and determine that the processing fluid supply or the valve is in an abnormal state when the integrated amount deviates from the target integrated amount.

3. The processing apparatus of claim 2, further comprising:

an arm configured to support the nozzle horizontally, a lift configured to pivot and lift the arm, and the supply pipe penetrates the arm and the lift, wherein the required amount is preset based on a volume of the supply pipe.

4. The processing apparatus of claim 2, wherein, in a case where a predetermined second time, which is shorter than the predetermined time, has elapsed from start of supply of the processing fluid, the controller is configured to sample the instantaneous flow rate a plurality of times over a predetermined period, and monitor whether an average value of sampled instantaneous flow rates is in a predetermined range.

5. The processing apparatus of claim 2, wherein, in a case where a deviation between the elapsed time and the predetermined time prior to an operation of the processing apparatus is in a predetermined range, the controller causes, during the operation of the processing apparatus, the start of the supply of the processing liquid from the nozzle is executed at a shifted timing from a time when the valve is opened to start supplying the processing fluid to the workpiece according to the deviation.

6. The processing apparatus of claim 1, further comprising:

an arm configured to support the nozzle horizontally, a lift configured to pivot and lift the arm, and the supply pipe penetrates the arm and the lift, wherein the required amount is preset based on a volume of the supply pipe.

7. The processing apparatus of claim 1, wherein, in a case where a predetermined second time, which is shorter than a predetermined time set in advance, has elapsed from start of supply of the processing fluid, the controller is configured to sample the instantaneous flow rate a plurality of times over a predetermined period, and monitor whether an average value of sampled instantaneous flow rates is in a predetermined range.

8. The processing apparatus of claim 1, wherein, in a case where a deviation between the elapsed time and a predetermined time prior to an operation of the processing apparatus is in a predetermined range, the controller causes, during the operation of the processing apparatus, the start of the supply of the processing liquid from the nozzle is executed at a shifted timing from a time when the valve is opened to start supplying the processing fluid to the workpiece according to the deviation.

9. The processing apparatus of claim 1, wherein, the controller is configured to monitor the rise of the flow rate during an operation of the processing apparatus each time the processing fluid is supplied to the nozzle.

10. The processing apparatus of claim 1, wherein the controller is configured to determine that processing fluid supply or the valve is in an abnormal state either when the elapsed time deviates a predetermined time set in advance, or when the instantaneous flow rate deviates a predetermined value set in advance.

11. The processing apparatus of claim 1, wherein the required amount is preset based on a volume of the supply pipe, a distance from a tip end of the nozzle to a surface of the workpiece, and a thickness of the processing liquid ejected from the tip end of the nozzle.

12. A processing method using a processing apparatus, the processing method comprising:

providing a chamber configured to accommodate an object to be processed ("workpiece"), a nozzle provided within the chamber to supply a processing fluid toward the workpiece, a flowmeter configured to measure a flow rate of the processing fluid supplied to the nozzle, a valve configured to perform an opening/closing of a flow path of the processing fluid supplied through the nozzle to a surface of the workpiece from a processing fluid supply source, and a controller configured to control a processing operation of the processing apparatus according to a processing recipe;

transmitting a control signal to the valve such that the valve is opened to start supplying the processing fluid to the workpiece;

calculating an integrated amount of the processing fluid supplied to the workpiece during a first period in which the flow rate rises by integrating the measured flow rate over an elapsed time until the integrated amount reaches a target integrated amount during the first period; and after the first period, measuring an instantaneous flow rate of the processing fluid supplied to the workpiece during a second period in which the flow rate is maintained in a substantially same level, and wherein the target integrated amount is a required amount of the processing fluid in the flow path that is required for the processing fluid to reach the surface of the workpiece from the processing fluid supply source, and preset based on a volume of the supply pipe, a diameter of the supply pipe, and a distance from a tip end of the nozzle to the surface of the workpiece.

13. A non-transitory computer-readable storage medium having stored therein a computer executable program containing computer code for performing a process, the process comprising:

transmitting a control signal to a valve in a flow path of a processing apparatus such that the valve is opened to start supplying a processing fluid through a nozzle to a surface of a workpiece from a processing fluid supply source;

calculating an integrated amount of the processing fluid supplied to the workpiece during a first period in which a flow rate of the processing fluid supplied to a nozzle of the processing apparatus rises, and measuring an elapsed time until the integrated amount reaches a target integrated amount during the first period; and after the first period, measuring an instantaneous flow rate of the processing fluid supplied to the workpiece during a second period in which the flow rate is maintained in a substantially same level, and wherein the target integrated amount is a required amount of the processing fluid in the flow path that is required for the processing fluid to reach the surface of the workpiece from the processing fluid supply source, and preset based on a volume of the supply pipe, a diameter of the supply pipe, and a distance from a tip end of the nozzle to the surface of the workpiece.

* * * * *